US010374363B2

(12) United States Patent
Nolting et al.

(10) Patent No.: US 10,374,363 B2
(45) Date of Patent: Aug. 6, 2019

(54) SHIELDED ELECTRIC CONNECTOR

(71) Applicant: Phoenix Contact GmbH & Co. KG, Blomberg (DE)

(72) Inventors: Daniel Nolting, Hiddenhausen (DE); Manuel Tünker, Dörentrup (DE); Valeri Reimchen, Steinheim/Sandebeck (DE); André Mühlenbernd, Bielefeld (DE); Kathrin Dober, Lemogo (DE); Cord Starke, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 15/553,003

(22) PCT Filed: Feb. 24, 2016

(86) PCT No.: PCT/EP2016/053817
§ 371 (c)(1),
(2) Date: Aug. 23, 2017

(87) PCT Pub. No.: WO2016/135170
PCT Pub. Date: Sep. 1, 2016

(65) Prior Publication Data

US 2018/0054026 A1 Feb. 22, 2018

(30) Foreign Application Priority Data

Feb. 25, 2015 (DE) ..... 10 2015 102 703

(51) Int. Cl.
*H01R 9/03* (2006.01)
*H01R 43/16* (2006.01)
(Continued)

(52) U.S. Cl.
CPC ..... *H01R 13/648* (2013.01); *H01R 9/032* (2013.01); *H01R 13/514* (2013.01);
(Continued)

(58) Field of Classification Search
CPC ..... H01R 43/01; H01R 43/20; H01R 4/01; H01R 4/02; H01R 4/58
See application file for complete search history.

(56) References Cited

U.S. PATENT DOCUMENTS 2,536,003 A * 12/1950 Dupre ..... H01R 9/0503 174/75 C
3,141,060 A * 7/1964 Norton ..... H02G 15/10 174/19
(Continued)

FOREIGN PATENT DOCUMENTS

CN 202276004 U 6/2012
DE 3912189 A1 10/1990
(Continued)

OTHER PUBLICATIONS

German Office Action, Serial No. 10 2015 102 703.8, Applicant: Phoenix Contact GmbH & Co. KG, dated Oct. 22, 2015.
(Continued)

*Primary Examiner* — Edwin A. Leon
*Assistant Examiner* — Oscar C Jimenez
(74) *Attorney, Agent, or Firm* — Reising Ethington PC

(57) ABSTRACT

The present disclosure relates to a shielded electric connector for connecting or distributing shielded electric lines or plug connectors with one another, and to methods for producing the shielded electric connector. Connector elements belong to a line or to a plug connector. Shielding sleeves or shielding housings of the lines and/or of the plug connectors are surrounded by a shielding housing, which consists of a cast metal body that has been cast in situ onto annular regions of the shielding sleeves or shielding housings in order to produce a local anchoring means with low electric contact resistance.

13 Claims, 13 Drawing Sheets

(51) Int. Cl.

| | |
|---|---|
| ***H01R 43/24*** | (2006.01) |
| ***H01R 13/648*** | (2006.01) |
| ***H01R 13/6592*** | (2011.01) |
| ***H01R 13/514*** | (2006.01) |
| *H01R 107/00* | (2006.01) |

(52) U.S. Cl.
CPC ..... *H01R 13/6592* (2013.01); *H01R 43/16* (2013.01); *H01R 43/24* (2013.01); *H01R 2107/00* (2013.01)

(56) References Cited

U.S. PATENT DOCUMENTS

| | | | | | |
|---|---|---|---|---|---|
| 3,441,659 | A * | 4/1969 | Laudig | H01R 4/20 | 174/88 C |
| 3,872,237 | A * | 3/1975 | Eyre | H01P 1/045 | 174/88 C |
| 4,090,767 | A | 5/1978 | Tregoning | | |
| 4,198,173 | A * | 4/1980 | Zehren | H01R 4/00 | 156/49 |
| 4,424,411 | A * | 1/1984 | Clabburn | B23P 11/00 | 174/84 R |
| 4,778,948 | A * | 10/1988 | Fitch | H01R 4/72 | 156/49 |
| 4,786,760 | A * | 11/1988 | Friedhelm | H01L 41/087 | 174/75 R |
| 4,832,382 | A * | 5/1989 | Kapgan | F16B 1/0014 | 174/DIG. 8 |
| 5,906,513 | A | 5/1999 | Peterson et al. | | |
| 5,980,288 | A * | 11/1999 | Jarvis | F21V 23/06 | 439/188 |
| 6,705,884 | B1 * | 3/2004 | McCarthy | H01R 4/5033 | 439/394 |
| 2005/0192708 | A1 | 9/2005 | Bertini | | |
| 2006/0258209 | A1 * | 11/2006 | Hall | H01R 24/542 | 439/578 |
| 2012/0329323 | A1 | 12/2012 | Fink et al. | | |
| 2013/0065438 | A1 | 3/2013 | Nickol | | |
| 2014/0318852 | A1 | 10/2014 | Adachi et al. | | |
| 2015/0096803 | A1 * | 4/2015 | Pope | H01R 4/72 | 174/84 R |
| 2016/0165665 | A1 * | 6/2016 | Noritake | H05B 3/04 | 219/548 |

FOREIGN PATENT DOCUMENTS

| | | | |
|---|---|---|---|
| DE | 19528678 | C1 | 1/1997 |
| DE | 102011012763 | A1 | 9/2011 |
| DE | 102010039750 | | 3/2012 |
| DE | 102012009790 | A1 | 11/2013 |
| EP | 2109194 | A2 | 10/2009 |
| JP | 2007294205 | A | 11/2007 |
| JP | 2008172033 | A | 7/2008 |
| JP | 2013115071 | A | 6/2013 |
| WO | 2011151373 | A1 | 12/2011 |
| WO | 2013138266 | A1 | 9/2013 |

OTHER PUBLICATIONS

German Office Action, Serial No. 10 2015 102 703.8, Applicant: Phoenix Contact GmbH & Co. KG, dated Jun. 10, 2016.

German Office Action, Serial No. 10 2015 102 703.8, Applicant Phoenix Contact GmbH & Co. KG, dated Jan. 20, 2017.

PCT International Search Report and Written Opinion, Int. Serial No. PCT/EP2016/053817, Int. Filing Date: Feb. 24, 2016, Applicant: Phoenix Contact GmbH & Co. KG., dated May 24, 2016.

English Translation of International Preliminary Examination Report, Int. Serial No. PCT/EP2016/053817, Int. Filing Date: Feb. 24, 2016, Applicant: Phoenix Contact GmbH & Co. KG, dated Sep. 8, 2017.

Japanese Office Action, Patent Application No. 2017-545267, Applicant: Okabe, Yuzuru, et al., dated Sep. 27, 2018.

Chinese Office Action, Application No. 201680012055.1, Applicant: Phoenix Contact GmbH & Co. KG, Title: Shielded Electric Connector, dated Nov. 2, 2018.

* cited by examiner

SHIELDED ELECTRIC CONNECTOR

TECHNICAL FIELD

The present disclosure relates to a shielded, electrical connector for connecting or distributing shielded, electric lines or plug connectors with one another, and to methods for producing the shielded, electrical connector.

Such a shielded, electrical connector may have the form of the connection between two coaxial cables, or the connection of several shielded cables with each other, forming a distributor, or the connection may be between a shielded cable and a plug connector, or it may assume the form of a shielded, multiway terminal block connecting several shielded plug connectors or shielded cables with each other.

BACKGROUND

An electrical connector with connecting cable having a metallic coupling apparatus with a union nut, or with a screw and an inwardly-directed collar engaging a crimped sleeve, creating the connection between the coupling apparatus and the shielding of the connecting cable as known from DE 196 13 228 B4.

Producing a shielded plug connector having a crimped shielding sleeve is costly. Many individual components are needed, and preparing the cable to be connected is performed by hand, as is mounting the many individual components. In the case of plug connectors having an angulated shape, mastering the production is even more difficult. Establishing the electric connection by crimping components is, furthermore, not always safe; in particular, the contact resistance at the crimp connection may alter when the temperature changes, or with age, resulting in a reduction of the shielding quality of the plug connector. From U.S. Pat. No. 5,906,513, a shielded, molded electrical connector is known, wherein a sleeve-shaped, metallic housing having slits for forming tabs is provided on the side of the cable, and the tabs are pressed onto the metal braiding shielding of the cable. Thereafter, the sleeve-shaped metal housing is embedded with a thermoplastic material behind the metallic connection coupling, on the bared metal braiding shielding, and on the cable end. The thermoplastic material contains wire strands that are pressed against the sleeve-shaped metal housing during the molding process, establishing good electric continuity between the cable and the connector, or to the sleeve-shaped housing of plug connectors. Also here, the contact resistances between the shielding parts may degrade in case of temperature changes and with age.

From DE 10 2008 018 403 A1 and WO 2011/151373 A1, a plug connector with a shielded cable connected therewith is known. The connector has a molded, shielding sleeve made of electrically conductive material, in particular of electrically conductive plastics, and electrically connects the cable shielding to the coupling nut of the plug connector. A plastic filled with metal fibers is generally understood as electrically conductive plastic. Such electrically conductive material may be injection-moldable (see DIN 24450). In detail, the electric line ends of the cable are connected in the plug housing where a metal sleeve is arranged. Subsequently, an insulating carrier is injection molded, the carrier extending from the line shield into the housing. An electrically conductive sleeve part is injection-molded around the insulating carrier so as to connect the line shield with the metal sleeve and by doing so with the housing shield of the electrical connector. Electrically conductive plastics, however, establish only weak contacts with metallic surfaces of the plug connector or of the cable so that the contact resistance at the transition surfaces between the electrically conductive plastics material and the metallic surfaces at the plug connector or at the cable shielding shows increased values, which may further deteriorate if gaps or cracks occur due to the shrinkage or the melting of the plastics.

Furthermore, conductive plastics have a lower screening attenuation than full metal.

GENERAL DESCRIPTION

It is the object of the present disclosure to create a shielded, electrical connector having a good shielding connection between shielded, electrical lines and/or shielded plug connectors.

It is a further aspect of the present disclosure to create a durable, shielded electrical connector with which the contact resistances between the involved components of the shielding remain low during the lifetime of the connector.

Another feature of the present disclosure is to create a shielded, electrical connector that can be produced easily and largely automatically, and has as few individual components as possible.

The solution to the problem that the present disclosure seeks to solve is to be found in the subject matter of the independent claims. Refinements of the present disclosure are defined in the dependent claims.

In detail, the shielded, electrical connector has one or several line elements, which belong to at least one line or to at least one plug connector. In the case of several lines, these can at least be partially connected with each other in order to form a distributor. The line elements may be exemplarily formed as lines of an electrical cable or as a continuation of plug contact elements of a plug connector. The connector further comprises one or several shielding sleeves and/or one or several shielding housings, which belong, as cable shielding, to at least one line, or, as housing shielding elements, to at least one plug connector. The present disclosure further comprises a shielding housing that connects either several shielding sleeves, or at least one shielding sleeve with at least one shielding housing, or connects several shielding housings with one another, or forms a part of the shielding housing. The shielding housing consists of a cast metal body, which has been cast in situ onto annular regions not only of one shielding sleeve or several shielding sleeves, but also of one shielding housing or several shielding housings. The cast metal body is an anchoring means with low electric contact resistance and effects a complete, in particular, gapless shielding of the connector. The shielding housing may also extend between two shielded cables or cable groups to be connected with each other.

In other words, the shielding housing preferably does not consist of prefabricated shell or sleeve parts, but it is integrally cast directly at and around the connector, in particular at and around plastic parts of the connector, when being assembled or during manufacture. Thus, liquid metal or a liquid metal alloy is cast at and around plastic parts of the connector. The shielding housing is thus cast in situ from liquid metal at the connector already partially manufactured, or cast in situ around components of the partially manufactured connector.

By doing so, a gap formation may be avoided, which may happen when a sleeve is crimped onto the shielding sleeve of a cable, or when the shielding comprises two crimped sleeves. Furthermore, the contact resistance is low between the shielding sleeves of cables and/or the shielding housings of plug connectors to the shielding housing, which is integrally cast in situ from liquid metal and/or which connects the shielding housings with each other. The electrical connections created by the shielding housing integrally cast in situ furthermore are durable and are subject, to a minor degree, to aging processes. Since employing the present disclosure means that one does not use prefabricated shielding sleeves that need to be mounted, producing the connector is even simplified. Simplification and quality improvement are apparent in the case of angle connectors.

When producing the shielding housing by casting metal directly at the shielding sleeves and/or the shielding housings, a good anchoring and a strong connection between the adjacent parts of the shielding results is established, leading to a low contact resistance between the parts of the shielding. When the materials of the parts to be connected with each other are appropriately selected, a metallurgical connection may even develop. Such a connection is particularly durable and of consistent quality.

According to an embodiment of the present disclosure, the shielding housing is at least partially cast on and around an intermediate insulation made of temperature-resistant, electrically insulating material. The intermediate insulation protects the line elements when casting the shielding housings. For handling the line elements when assembling the connector, the ends of the line elements, for example the insulated wires of a cable, are stripped of the shielding sleeve, which typically consists of a metal braiding. Even if the line elements are covered by a line insulation, it may be desirable to use additional intermediate insulation for better protection of the line elements against the hot metal melt flow when casting the shielding housing. The intermediate insulation may be made of thermally-resistant, electrically insulating material and be sufficiently thick to meet the requirements when casting the shielding housing.

In the case of a plug connector for mating connection with a mating plug connector, the rearward continuations of the contact elements of the plug connector are used as line elements. The contact elements or the line elements are appropriately housed by an electrically insulating connector housing. A coupling half of the plug connector, designed to cooperate with the other coupling half of the mating plug connector, is assembled around this connector housing holding the contact elements or the line elements. The other coupling half is effective as an electric shielding connection. This is a simple and secure shielded plug connector design.

The shielding housing of the plug connector may be a metallic connection part and comprise metallic half shells, which are fixed on the insulating connector housing using a coupling ring, and form a part of the coupling half of the plug connector. A rearward edge portion of the metallic connection part is insert-molded or cast around with the shielding housing so that a good electrical connection with the shielding housing of the plug connector emerges, constituting the shielding performance degree of the plug connector.

If the plug connector is formed for a data line and preferably has several line elements, these elements are protected by an intermediate insulation made of electrically insulating and thermally low conductive material. The thermal conductivity of the intermediate insulation material is preferably between 0.01 and 10 W/m·K. To be considered are, for example, polyethylene terephtalat (PET), polyurethane compact (PUR), polyimide (e.g., Kapton®)), polyetherimid (PEI), polytetrafluoroethylene (PTFE), polyvinal chloride (PVC), polyamide (e.g., Nylon® or Perlon®), polypropylene (PP), polycarbonate (e.g., Makrolon®), epoxy resin, polymethyl-methacrylate (PMMA), polyethylene (PE), polystyrene (PS), polysiloxane (silicon), and polybutylene-terephthalate (PBT). Where required, the intermediate insulation consists of foamed plastics with which a thermal conductivity between 0.01 and 0.1 W/m·K, preferably about 0.02 W/m·K, may be achieved. Thereby, sound protection of sensitive wire insulation is achieved when casting the shielding housing.

If one of the line elements of the plug connector is on protective earth (PE-wire), the shielding housing is preferably integrally cast with a cast branch, directly on the protective earth. This is an easy and secure connection between the outer shielding and the protective earth (PE-wire) running inside, and in total simplifies the construction of the plug connector.

In the case of a power plug connector, the intermediate insulation is produced from an electrically insulating and material with good thermal conductivity. The shielding housing is preferably provided with cooling fins and is, including the cooling fins, in particular cast in situ from metal onto the intermediate insulation with good thermal conductivity. In this case, the intermediate insulation material thermal conductivity is preferably between 0.2 and 10 W/m·K. A possibility is LATICONTHER® or a prefabricated intermediate insulation made of ceramics. In case of high load and great heat development, an effective heat dissipation may occur with the power plug connector, having a simple design, nevertheless.

With both a data connector and a power connector, the intermediate insulation may be used, either as prefabricated intermediate insulation or, when thermoplastic plastics are used, as a body injection-molded in situ, and carried out before the shielding housing is cast, allowing an efficient production process.

The connector according to the present disclosure may also be formed as a multiway terminal block for one or several shielded lines and/or one or several shielded plug connectors. A multiway terminal block or distributing body having several connection points for line elements is provided, which belong either to one or several lines or to one or several plug connectors. This distributing body and the adjacent line elements are protected when producing the shielding housing and also later while operating the device. The shielding housing directly surrounds the intermediate insulation and is, depending on the connection and distribution partner, cast in situ either at annular areas of shielding sleeves of the shielded lines, and/or at end areas of shielding housings of the plug connectors, and therefore closely connected. The construction of the distributor therefore allows for a plurality of various multiway terminal blocks or distributing bodies, wherein one or several plug connector connections or one or several direct line connections may also be used in a variety of ways.

In order to give the present disclosure an aesthetically pleasing look and to electrically insulate the shielding housing, as it is common in the trade, the shielding housing is preferably surrounded with an insulating protective shell made of plastics.

The shielding housing consisting of cast metal may, for example, consist of a low-melting metal alloy. In this case, the solidus temperature is between 120° and 420° C. The metal alloy may in particular be a metal solder, e.g., a tin solder. When using tin solder (melting temperature about 230° C.), for example, no damages of the molded-in plastic parts, as of line insulations and intermediate insulation, appeared. In particular, when using metal solder, the shielding housing may, when being cast in situ, fuse components, e.g., a tinning of the shielding sleeves or shielding housings, and melt together, establishing a particularly low-resistance shielding connection.

The present disclosure also relates to methods for producing the shielded, electrical connector in its various embodiments.

The method for producing the shielded, electrical connector is therefore generally performed as follows:

a) Connecting the free ends of the line elements with one another
b) Optionally applying the intermediate insulation on the free ends of the line elements, which are connected with one another
c) Forming the shielding housing by casting around one or several bared shielding sleeves and/or one or several shielding housings and, if desired, around the intermediate insulation with liquid metal In this process, applying the optional intermediate insulation may, dependent on material, take place by injection molding in situ onto the free ends of the line elements, or a prefabricated intermediate insulation may be applied.

If the shielded, electrical connector is to connect two shielded lines with each other, the shielding sleeves and the line elements are bared at the end of the two lines. The free, bared ends of the line elements are connected with each other, and the intermediate insulation is placed onto the free, bared ends of the line elements, which are connected with each other. The intermediate insulation and the shielding sleeves, after being bared, are then cast around with liquid metal for forming the shielding housing. This results in a connector with a low electric contact resistance between the shielding sleeves of the lines to be connected with each other and the shielding housing of the connector. This low electric contact resistance promises to stay permanently low, even in case of rough handling the connector.

When producing an electrical, shielded plug connector where line elements of a shielded line are to be connected onto contact elements of the connector, the shielding sleeve and the line elements are bared at the end of the shielded line. The contact elements of the plug connector are fixed at the end of the line elements of the shielded line. The contact elements are insulated from each other by inserting them into the insulating connector housing. Between the insulating connector housing and the location where the line elements have been bared from the common insulating shell, therefore on line elements that remain bared or are individually insulated, the intermediate insulation is applied, e.g., by means of casting around a temperature-resistant plastic material. Preferably, a plastic is used which has a temperature resistance in the range from 180° C. to 230° C. Subsequently, the intermediate insulation and the bared shielding sleeve of the line is cast around with liquid metal for forming the shielding housing. By doing so, a plug connector with a simple, robust construction can be produced wherein the electric contact resistance between the shielding sleeve of the line connected and the shielding housing of the plug connector is low and promises to stay low during the lifetime of the plug connector.

When designing the connector as a multiway terminal block, depending on whether the multiway terminal block has to be directly connected with one or several lines, or whether the multiway terminal block has to be provided with one or several individual plug connectors, the shielding sleeve and the line elements at the end of the line or lines to be connected are bared and/or plug connectors are provided having respective shielding housing and respective line elements. Subsequently, the line elements are connected with a distributing body. The intermediate insulation is then applied on the bared line elements and around the distributing body, e.g., by insert molding using plastics. The intermediate insulation and every bared shielding sleeve and/or, in case of a plug connector, the edge area of the shielding housing, is then cast around with liquid metal for forming the shielding housing. The present disclosure therefore makes it possible to design a large variety of electrically shielded, multiway terminal blocks.

With the method according to the present disclosure, solder connections between the shielding housing and the shielding sleeve can be produced by partially fusing solder material at the respective shielding sleeve. Such solder connections are generated when casting the metallic shielding housing, and if preparations at the respective shielding sleeve have been made, for example, if tinned wire meshes are used as a shielding sleeve.

In the following, the present disclosure will be described in more detail using embodiments and referring to the figures, wherein same and similar elements are partially provided with same reference signs, and the features of the different embodiments can be combined with each other.

BRIEF DESCRIPTION OF THE DRAWINGS

Exemplary embodiments of the present disclosure are described with the help of the drawings in which.

DETAILED DESCRIPTION

Figure 17:
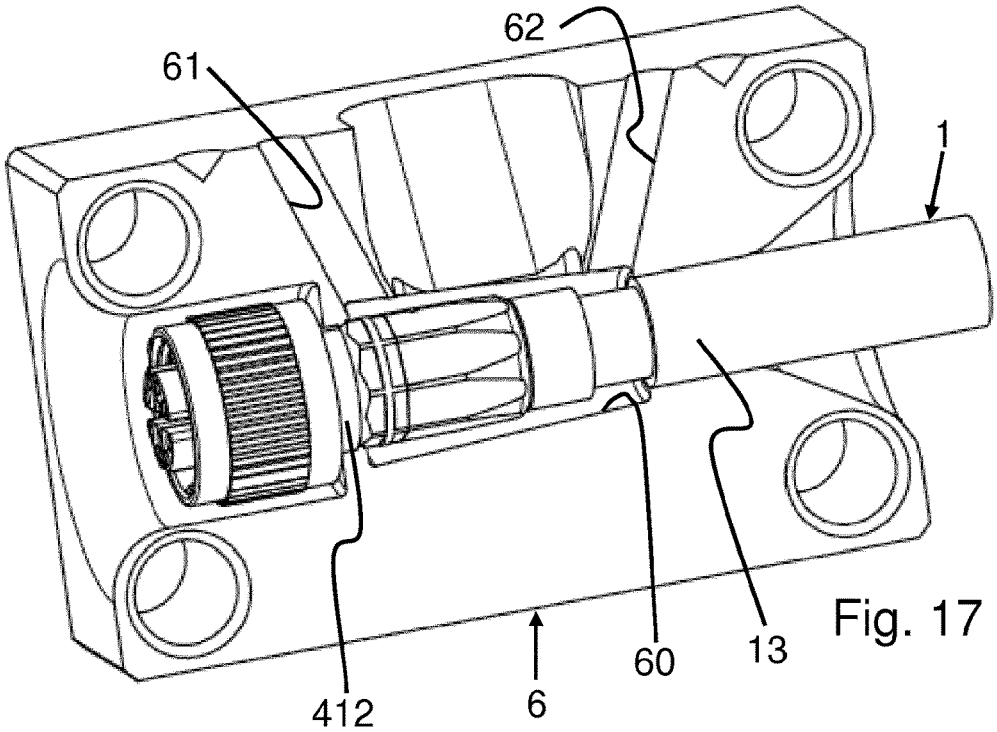
FIG. 17 shows the plug connector head with a molded around cable end, inserted into a mold for metal casting.

FIGS. 1-6 show the formation of a coaxial cable connector. The coaxial cables form a first shielded line 1 and a second shielded line 2. Each line comprises a conductor element 11 or 21, a conductor insulation 12 or 22, a shielding sleeve 10 or 20 and an insulating jacket 13 or 23. For connecting the conductor elements 11, 21 with each other, a metallic coupling sleeve 31 is used, which electrically connects the two bared ends of the conductor elements 11 and 21 with each other. An intermediate insulation 32 made of temperature-resistant, insulating plastics is injection-molded into the space between the conductor insulations 11 and 22 so that the conductor insulations of the two coaxial cables face each other at approximately the same diameter. The gap between the two bared insulating jackets 13 and 23 is closed by a shielding housing 30 electrically connecting the shielding sleeves 10 and 20 with each other. The shielding sleeves 10, 20, for example, consist of a metal wire mesh, so that with casting around, anchoring and electrical contact with the shielding housing 30 are good. This results in a low electric contact resistance between the shielding sleeves 10, 20, on the one hand, and the shielding housing on the other hand. The shielding housing 30 therefore consists of a metal body cast in situ and produced by means of a metal casting tool. A corresponding mold for metal casting is shown in FIG. 17. If needed, the shielding housing 30 cast in situ is made without sprue using hot-runner technology, as it is, for example, described in DE 10 2012 009 790, which is hereby incorporated by reference.

Figure 1:
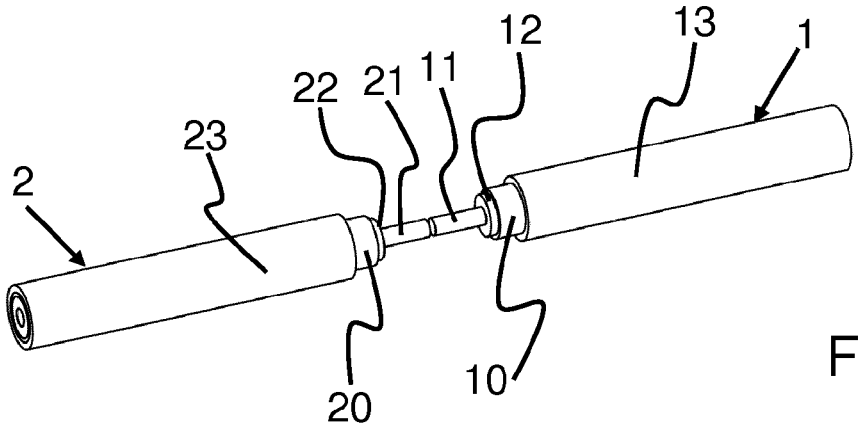
FIG. 1 shows two coaxial cables with stripped inner conductors facing each other and with bared ends of the shielding sleeves.
Figure 2:
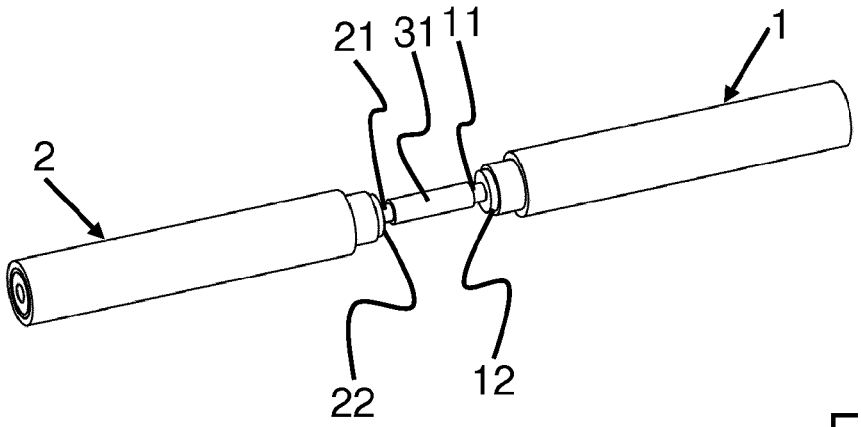
FIG. 2 shows the inner conductors connected with a coupling sleeve.
Figure 3:
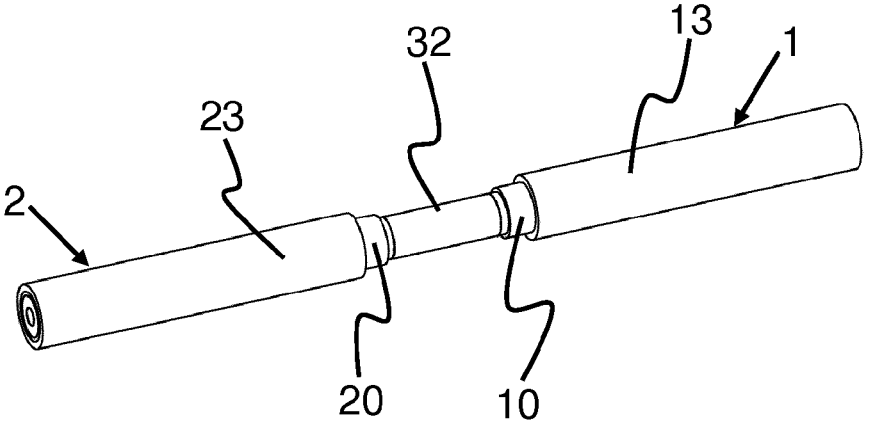
FIG. 3 shows the coupling sleeve provided with inter mediate insulation.
Figure 4:
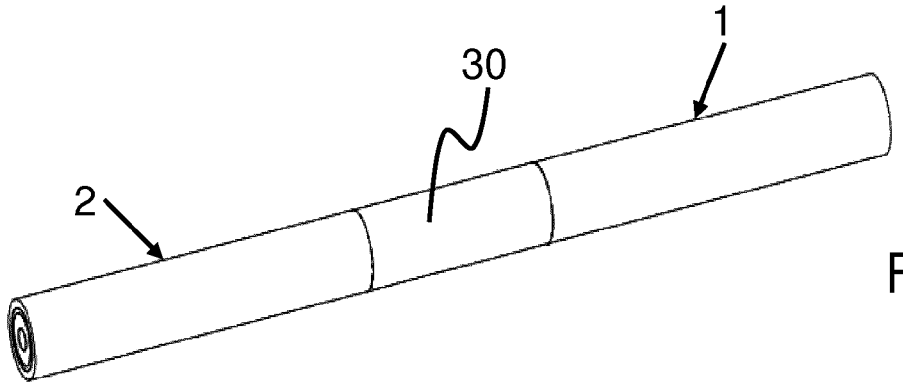
FIG. 4 shows the shielding sleeves of the two coaxial cables, connected via a shielding housing.
Figure 5:
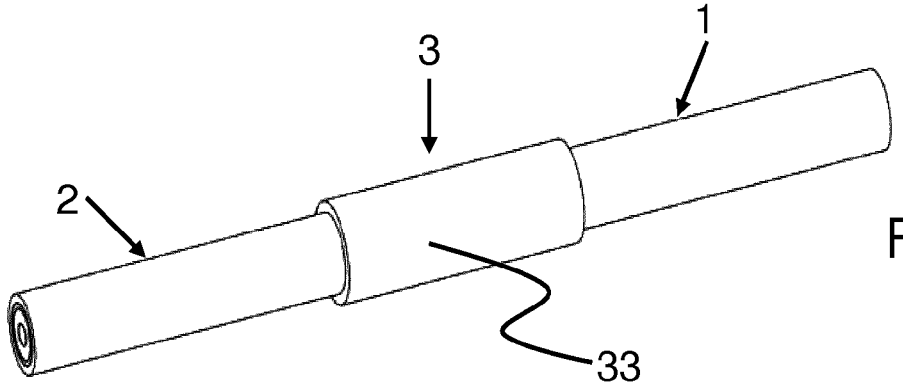
FIG. 5 shows the coaxial cable connector of FIG. 4, provided with a protective shell.
Figure 6:
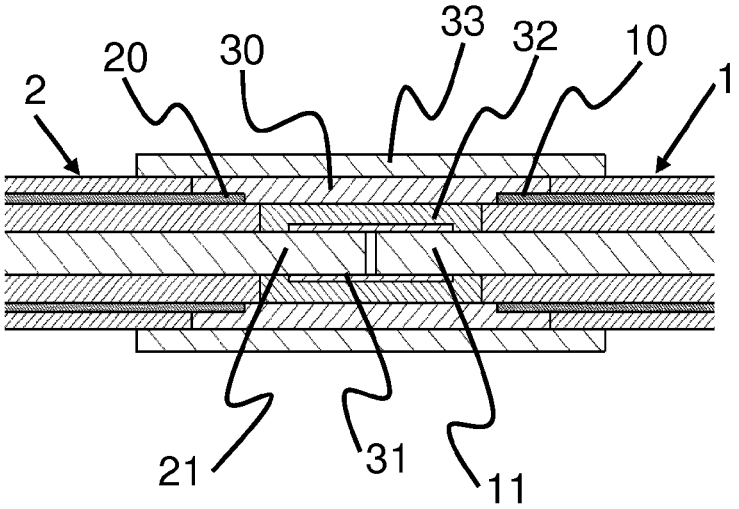
FIG. 6 is a longitudinal section through the coaxial cable connector of FIG. 5.
Figure 7:
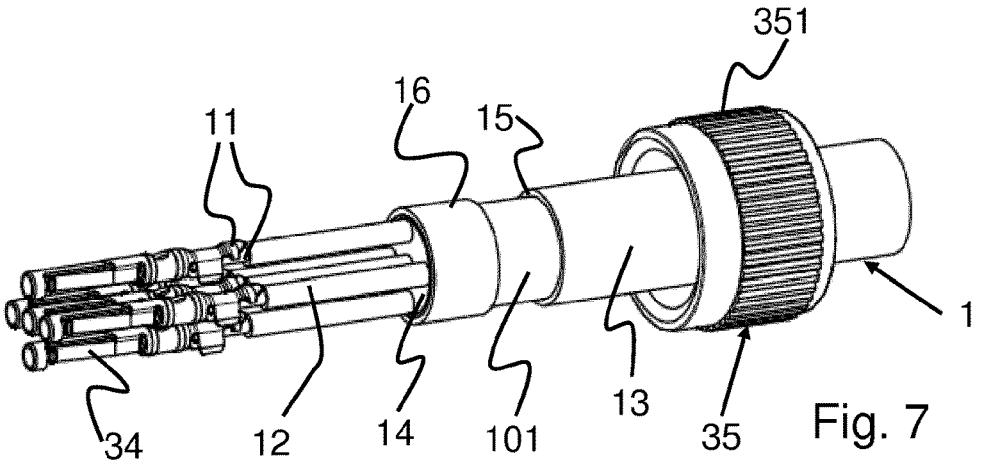
FIG. 7 shows a shielded cable with contact elements crimped at the stripped conductor ends.

In the design according to FIG. 4, the coaxial cable connector can be used as such. A further protective shell 33 has been placed around the shielding housing 30 and around the adjacent ends of the lines 1 and 2. In this manner, the standard design of a connector 3 is established. The shielded connection between the two lines 1 and 2 thus is complete.

FIGS. 7-13 show the formation of a plug connector connecting a shielded line 1 to contact elements 34 of the plug connector. The shielded line 1 as a cable comprises one or several conductor elements 11, a conductor insulation 12, a shielding sleeve 10 and an insulation jacket 13 all the way around. As may be seen from FIG. 7, the front end of line 1 is dismantled so that the bared ends of the conductor elements 11, onto which the contact elements are crimped, protrude from the conductor insulation 12. In addition, the shielding sleeve 10 and the insulation jacket 13 are shortened at the front end of line 1 by means of a cut at 14. Furthermore, the insulation jacket 13 has been incised by means of a cut at 15, reaching the shielding sleeve 10, and an insulation jacket edge portion 16 has been shifted forward towards the line end in order to have a shielding annular area 101, which is axially limited on both sides. Furthermore, a union nut 351 as part of a coupling half 35 is shifted onto the end of line 1 until it reaches the intact insulation casing 13.

Figure 8:
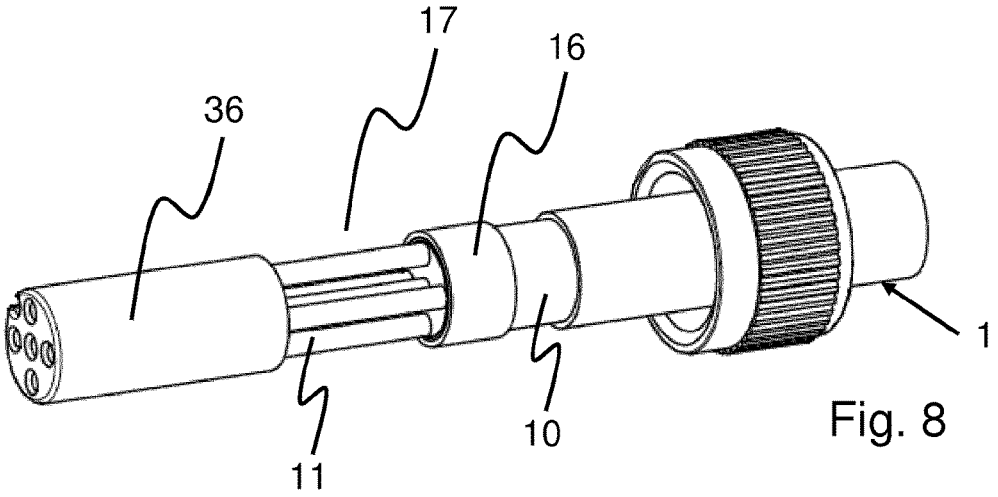
FIG. 8 shows the contact elements plugged in a connector housing.

The ends of the conductor elements 11 with the crimped contact elements 34 are to be shifted into boreholes of an insulating connector housing 36, so as to reach the state shown in FIG. 8. As shown, there is an area 17 that remains free between the connector housing 36 and the insulating jacket edge portion 16. The individual conductor elements 11, provided with conductor insulation 12, are arranged in area 17, as shown in FIG. 8. This exposed area 17 is closed by injection molding using an insulating plastic, e.g. Macromelt, for forming an intermediate insulation 32, as shown in FIG. 9.

Figure 9:
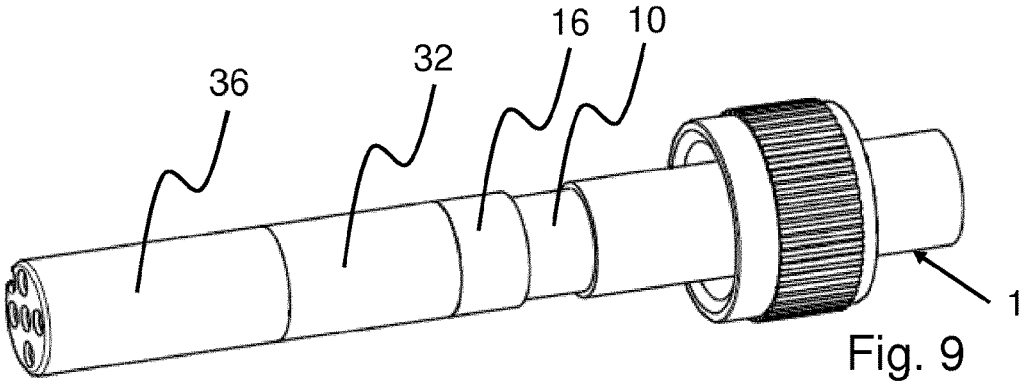
FIG. 9 shows the connectors cast around with an intermediate insulation outside the connector housing.
Figure 10:
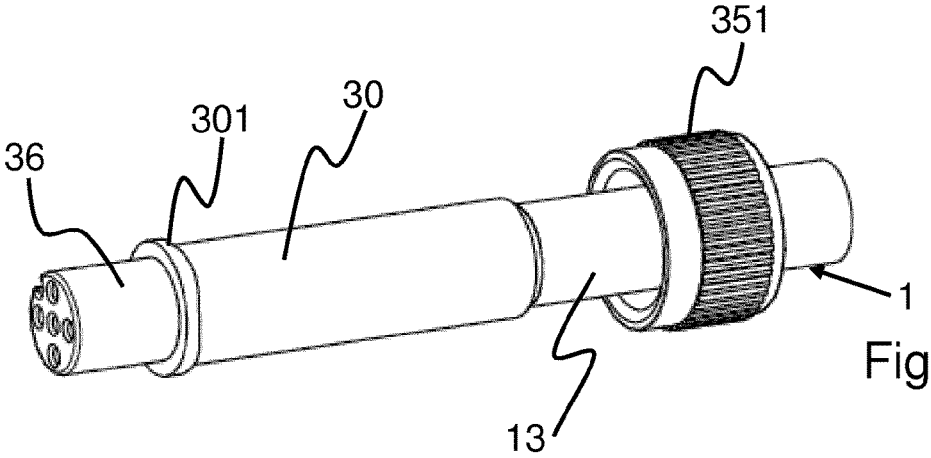
FIG. 10 shows the cable end cast around with a metallic shielding housing having an annular flange.
Figure 11:
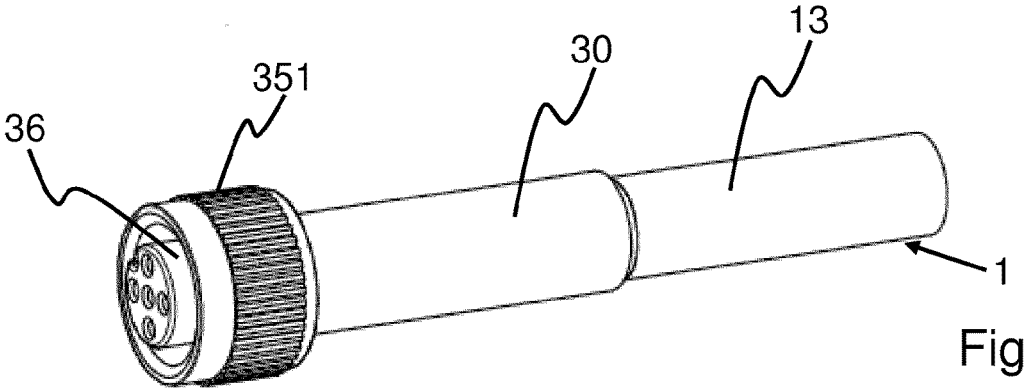
FIG. 11 shows the shielded plug connector.
Figure 12:
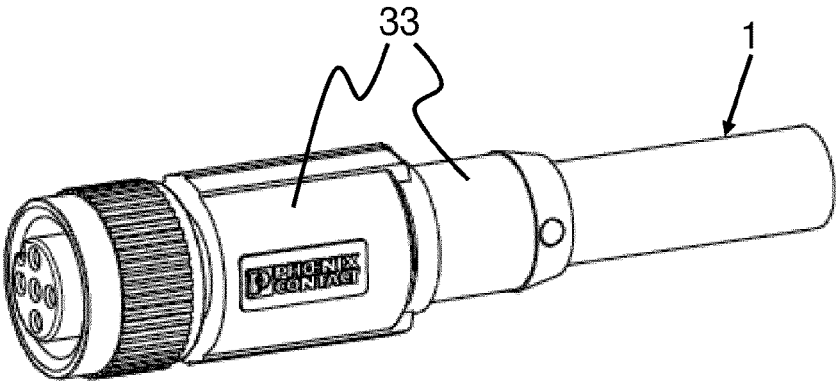
FIG. 12 shows the plug connector of FIG. 11, surrounded with a protective shell.
Figure 13:
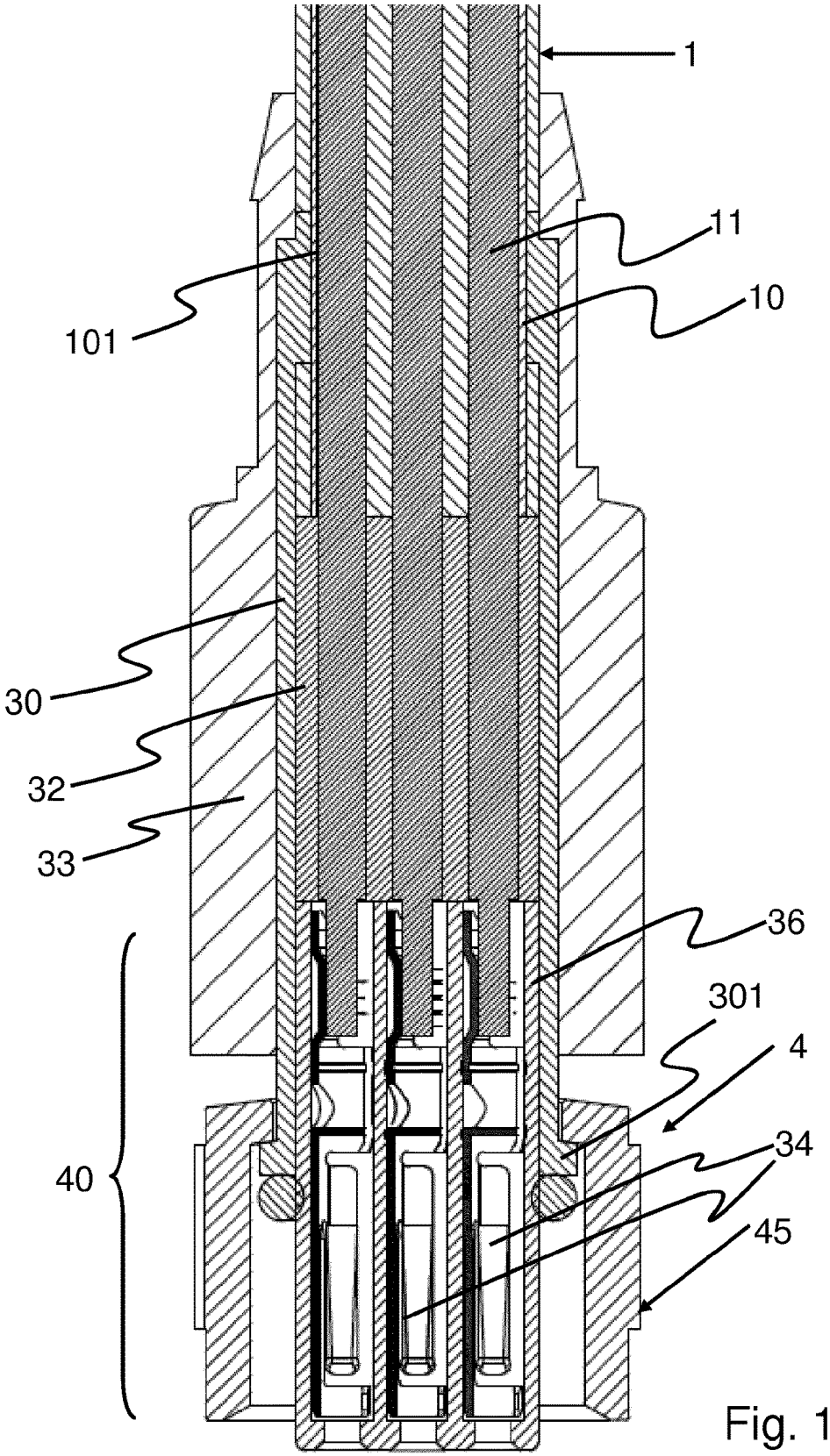
FIG. 13 is a longitudinal section through the plug connector of FIG. 12.
Figure 14:
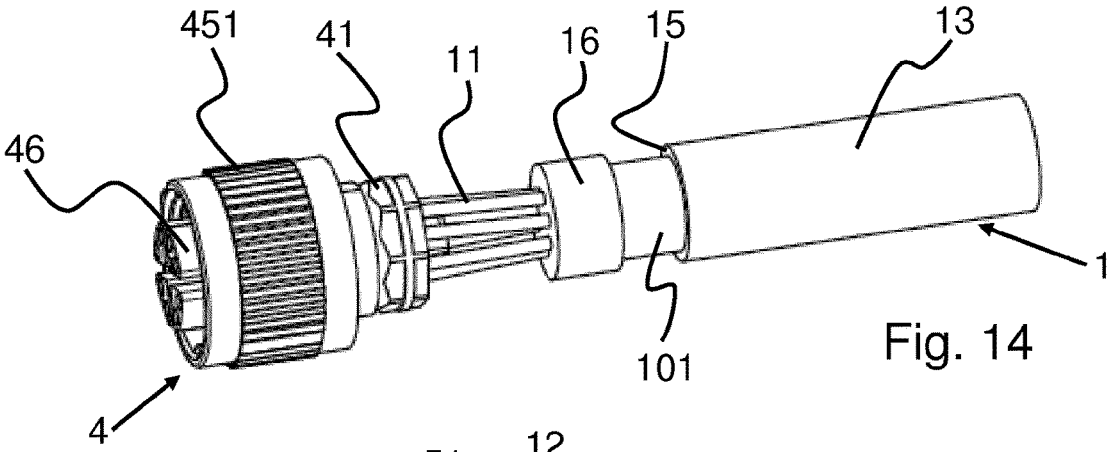
FIG. 14 shows a prepared cable end connected with a plug connector head.

Starting from the state shown in FIG. 9, a shielding housing 30 is produced by casting liquid metal around the intermediate insulation 32 and the shielding sleeve 10 in the annular region 101. The shielding housing 30, so cast in situ, also partially runs around the insulating connector housing 36, hence forming an annular flange 301. The captured union nut 351 may now be shifted forwards across the shielding housing 30 until engaging the annular flange 301, as shown in FIG. 11. This is the serviceable state of the plug connector. In order to obtain the commonly commercially available shape, a protective shell 33 is injection-molded over the shielding housing 30, wherein the connector adopts the appearance according to FIGS. 12 and 13.

Producing a further plug connector 4 is described according FIGS. 14-19. Firstly, a head of the plug connector 4 is connected to the end of the conductor element 11 of the line 1. For that purpose, the conductor elements 11 and the shielding sleeve 10 have been bared in the shielding annular portion 101, as it has been described using FIG. 7.

The head of the plug connector 4 has a union nut 451, which is part of the coupling half that cooperates with a mating plug connector (not shown), connecting the plug connector 4 with the mating plug connector pairwise. The front end of an electrically insulating connector housing 46, which is covered up by the union nut 451, can be seen. The contact elements, which are connected to the bared ends of the conductor elements 11, are arranged in the housing 46. The head of the plug connector 4 also comprises a metallic connection part 41, which protrudes at the rear end of the plug connector head and runs forward and around the electrically insulating connector housing, ensuring the shielding effect when coupled with a mating plug connector.

Figure 15:
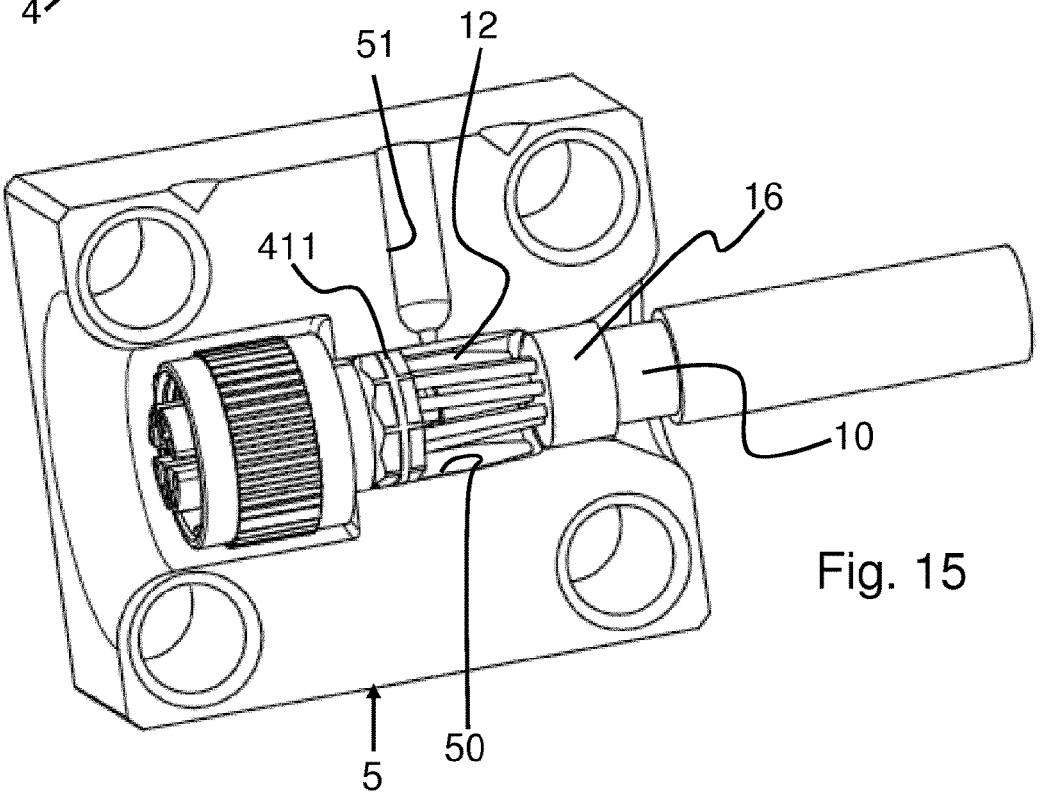
FIG. 15 shows the cable end with plug connector head inserted in an injection mold.

In FIG. 15, an open injection-molding tool 5 is shown, which has a hollow space for accepting the combination of the head of the plug connector 4 and the line 1. The metallic connection part 41 has a first seal ring portion 411 which, together with the insulating jacket edge portion 16, confines a casting cavity 50. An injection molding channel 51 leads to this casting cavity 50 and electrically insulating plastic is injected through this channel to clad the conductor elements 11. After cooling down, an intermediate insulation 32 forms, as shown in FIG. 16.

Figure 16:
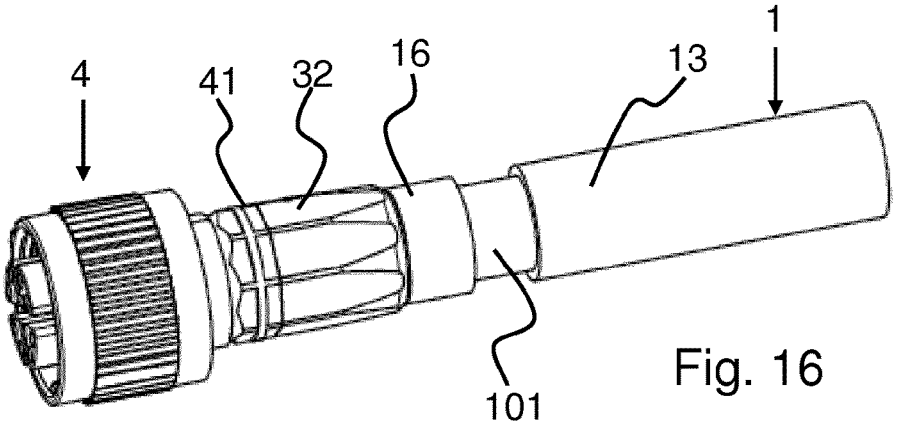
FIG. 16 shows the cable end close to the plug connector head, molded around with an intermediate insulation.
Figure 18:
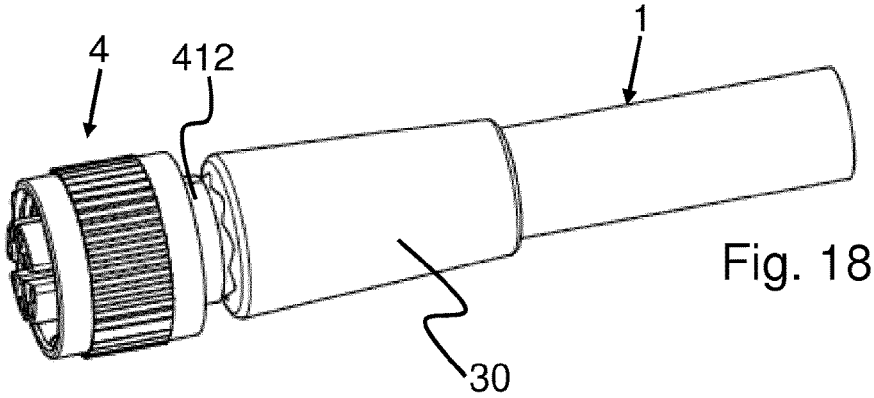
FIG. 18 shows the plug connector cast around with a metallic shielding housing.
Figure 19:
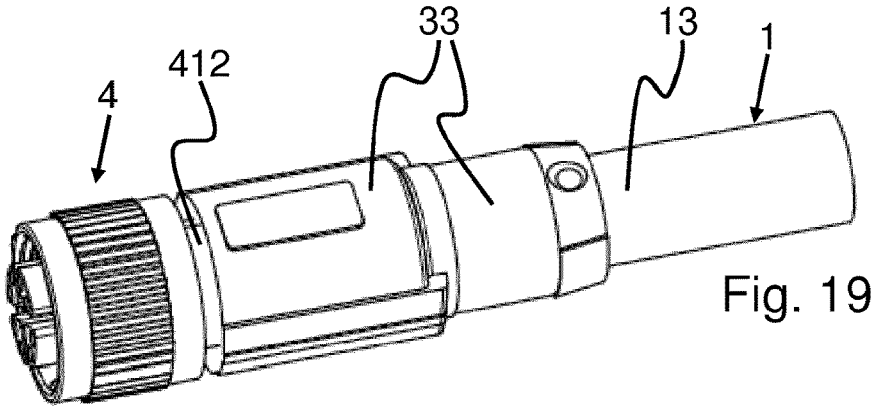
FIG. 19 shows the plug connector of FIG. 18, provided with a protective shell.

The rough plug connector according to FIG. 16 is inserted into the cavity of tool 6 for casting metal (FIG. 17), wherein a casting hollow space 60 is confined between the insulating jacket 13 of the line 1 and a second seal ring portion 412. Casting channels 61 and 62 lead into this casting hollow space 60. Liquid metal of a metal alloy, e.g., tin solder, flows through these channels. After cooling down, the solidified metal alloy forms the shielding housing 30. The shielding housing 30 surrounds the intermediate insulation 32, the insulating jacket edge portion 16 and the shielding sleeve 10 in the shielding annular area 101. Overflow, which can occur during the molding process, is removed, hence, a serviceable plug connecter is cast, as shown in FIG. 18. Commercially available plug connectors, however, also have a protective shell 33 around the shielding housing 30, as shown in FIGS. 19 and 20.

For producing such a commercially available plug connector, the serviceable plug connector is inserted into a casting hollow space of a further injection molding tool (not shown) in such a way that the injection tool seals both at the seal ring portion 412, and at an unaffected area of the insulating jacket 13 on the other side of the shielding housing. Then, the plug connector of FIG. 18 is cast around with insulating plastics between the seal ring portion 412 and the unaffected area of the insulating jacket 13 so as to form the protective shell 33 surrounding the shielding housing 30, thus producing a commercially available plug connector as seen in FIG. 19.

The operations described can be performed fully automated. By splitting the process up into individual steps and performing these steps along an assembly line, which may also be designed as a circular table, a fast production is possible. In doing so, the whole cycle time may be less than if the plug connector were to be produced in a single molding cycle for producing thicker-walled items. If insert molding with insulating plastic and casting around with liquid metal for three consecutive plug connectors are performed simultaneously, the cycle time per unit plug connector is determined by the longest cycle time in the production process. It should be noted that casting around with metal has a very short cycle time.

Figure 20:
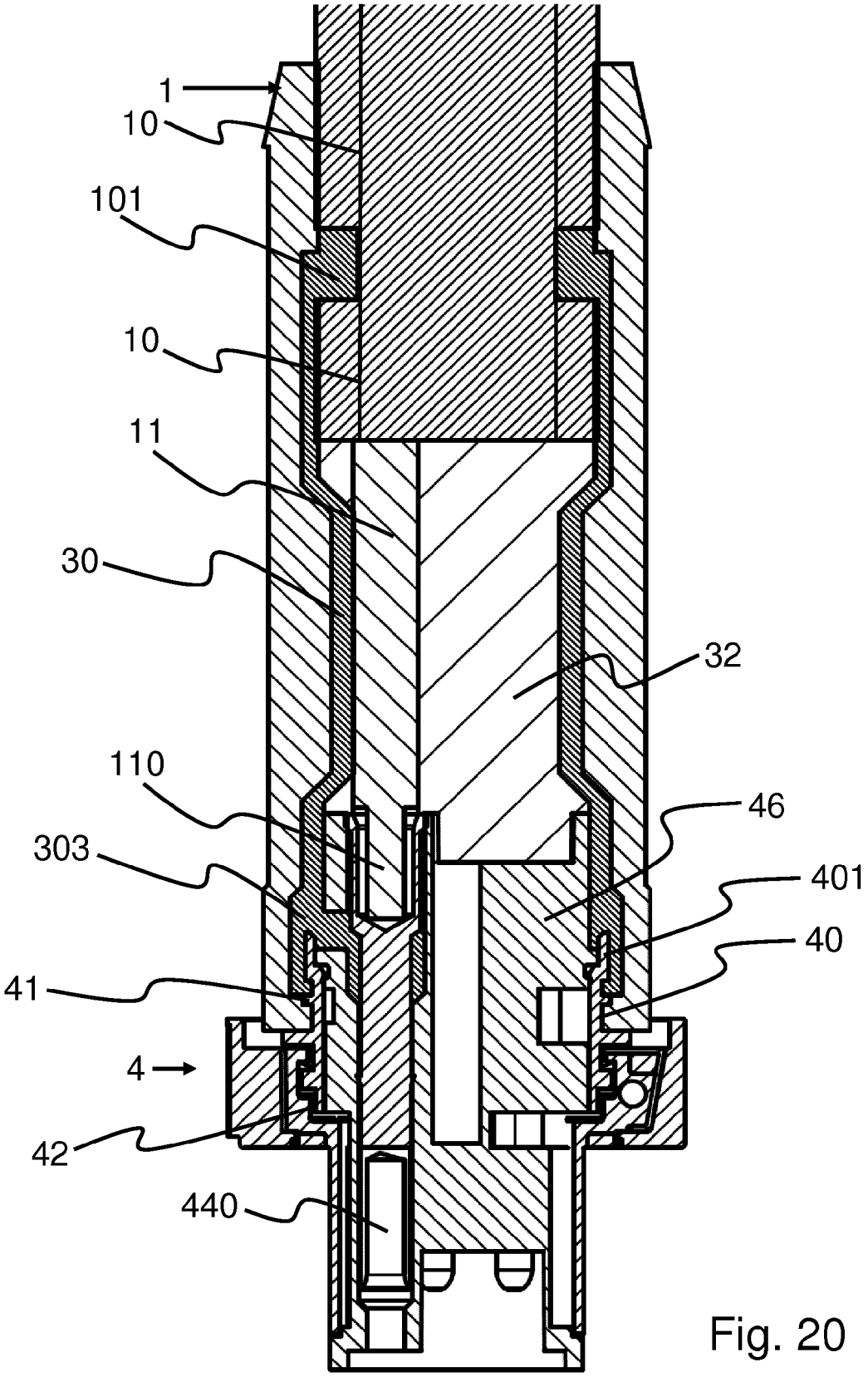
FIG. 20 is a longitudinal section through a power plug connector with protective earth connection.
Figure 21:
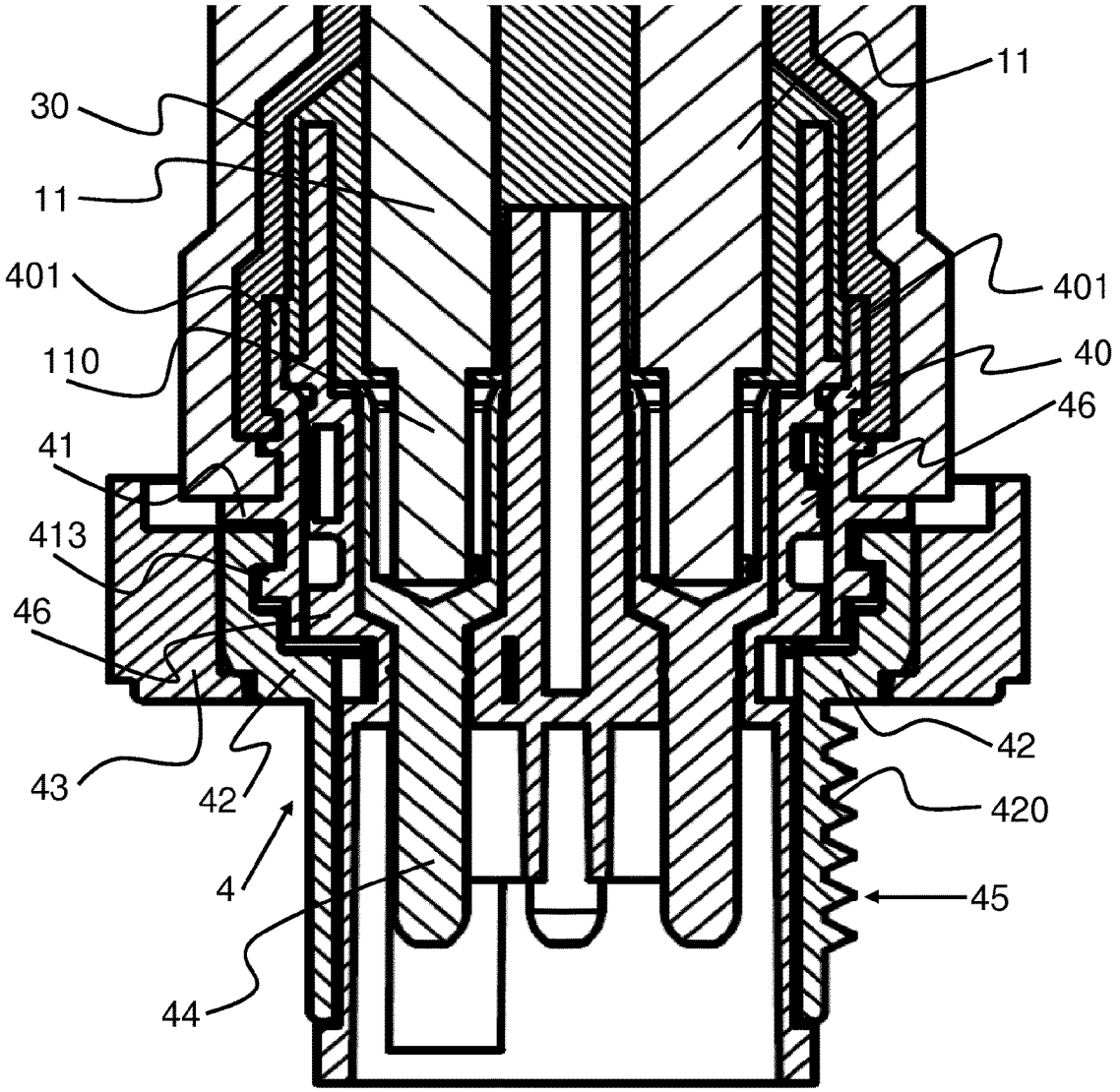
FIG. 21 is an enlarged longitudinal section through the head of the power plug connector in a pivoted section plane.

FIGS. 20, 21 show a longitudinal section through a power plug connector having a protective earth connection (PE-connection) of the shielding housing 30. As may be seen therefrom, the blank ends 110 of the conductor elements 11 are connected with contact elements 44, mechanically and therewith also electrically, for example by soldering, squeezing or crimping. The head of the plug connector 4 has an electrically insulated connector housing 46, having axial boreholes where the front ends of the contact elements 44 are inserted. Around the connector housing 46, a tubular, metallic connection part 41 extends, being provided with engaging protrusions 413 for holding metallic half shells 42 which, together with screw joint 420, form part of the coupling half 45 of the plug connector 4. The half shells 42, of which there are two, for example, are held by press force on the metallic connection part 41 and on the insulating connector housing 46 by means of a collar ring. The metallic connection part 41 and the half shells 42 form a shielding housing 40 around the connector 4 concerned. The shielding housing 40 has a rear annular area 401 where it is closely connected with the shielding housing 30, due to the metal casting in situ of the shielding housing 30.

The power plug connector according FIGS. 20 and 21 is similarly produced, as described using FIGS. 14-19. The end of the line 1 is provided with a shielding annular area 101 for baring the shielding sleeve 10. At the head of the plug connector 4, the metallic connection part 41 can be found which, together with the half shells 42, constitutes the shielding at the whole plug connector head. The shielding at the plug connector 4 is effected by the shielding housing 30, which has been produced by means of the metal casting in situ in the manner described with the help of FIGS. 14-19.

A contact element 440 (FIG. 20) guides protective earth (PE) and is connected to the shielding housing 30 directly cast in situ together with a cast branch 303. With this example, the intermediate insulation 32 consists of an electrically insulating and thermally poorly conducting material, for protecting the conductor elements 11 against the heat of the metal melt, when producing the shielding housing 30 by means of metal casting.

Figure 22:
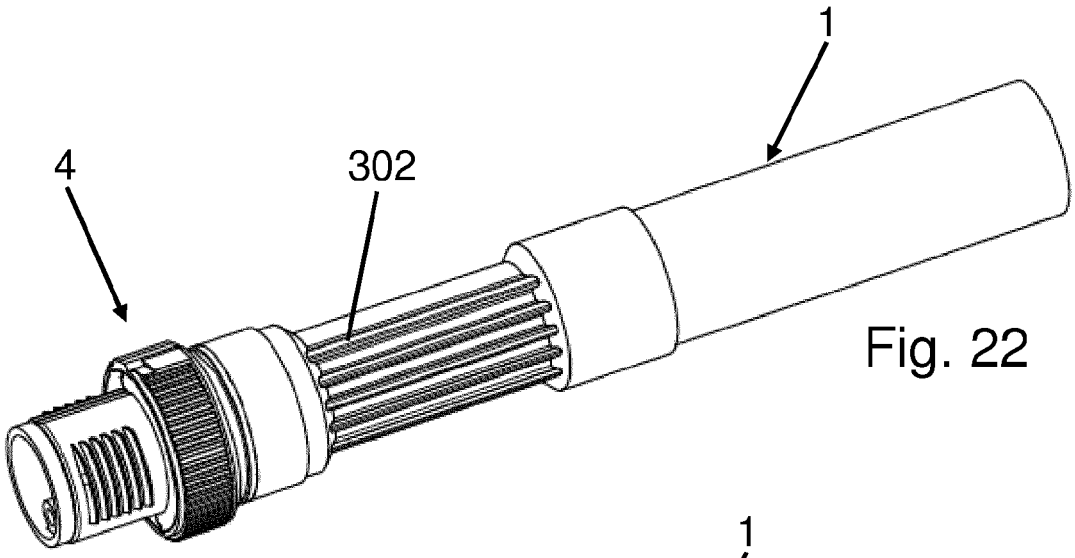
FIG. 22 is a perspective view of a power plug connector.
Figure 23:
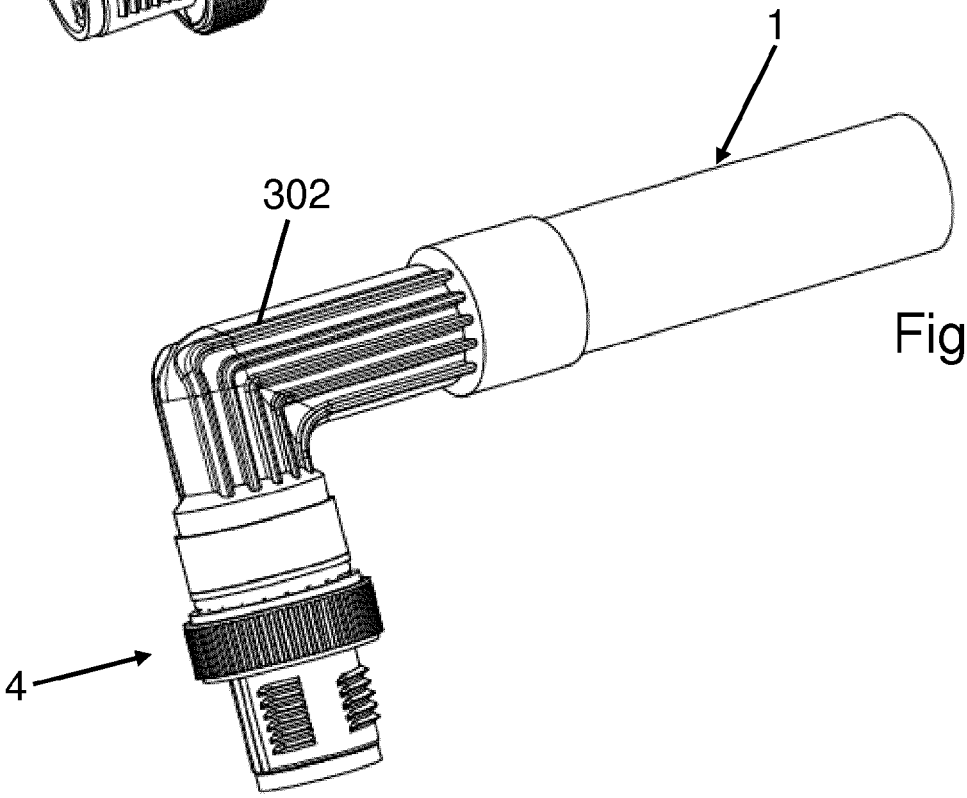
FIG. 23 shows a power plug connector in angular shape.
Figure 24:
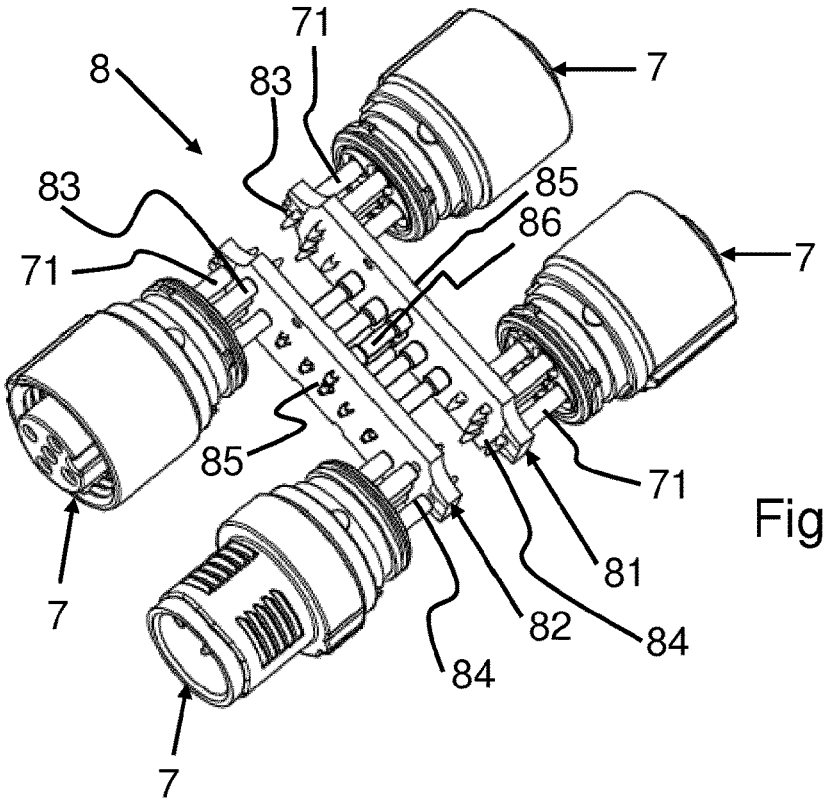
FIG. 24 shows a distributing body of a multiway terminal block.

FIGS. 22 and 23 show a power plug connector, the inside of which is constructed similarly to that of the plug connector according to FIGS. 20 and 21, however, the intermediate insulation 32 consists of electrically insulating, yet thermally highly conductive material, hence enabling better dissipation of the power plug connector waste heat produced during operation. A heat conductivity value of 0.2 W/m·K to nearly 10 W/m·K with a good electrical insulation value may be achieved using filled plastics. The intermediate insulation 32, however, may also consist of a prefabricated ceramics component, which may have an even greater heat conductivity value. The shielding sleeve 30 also has cooling fins 302 inside, improving heat dissipation from the within the power plug connector.

Using the example of the power plug connector in FIG. 23, it is shown that such a power plug connector may also be made in the form of an angular plug connector. Nevertheless, this also is true with the other described designs. One only needs injection molding tools or metal casting tools fitted to the angular shape of the casting hollow space.

A data plug connector is produced in an analogue manner, wherein a plastic with a low heat conductivity may be used for the intermediate insulation 32, because less heat has to be dissipated during its operation. In return, the conductor elements 11 are even better protected against the impact of heat when the shielding housing 30 is cast in situ.

FIGS. 24 to 28 show a shielded multiway terminal block constituting a connector for connecting several shielded plug connectors 7 with each other. The connection of the individual plug connectors 7 is carried out via a distributing body 8. This distributing body 8 contains two conductor boards 81 and 82 with distributing conductors between connection points 83, 84, and 85. The connection points 85 are connected with each other via cross connection 86.

Figure 25:
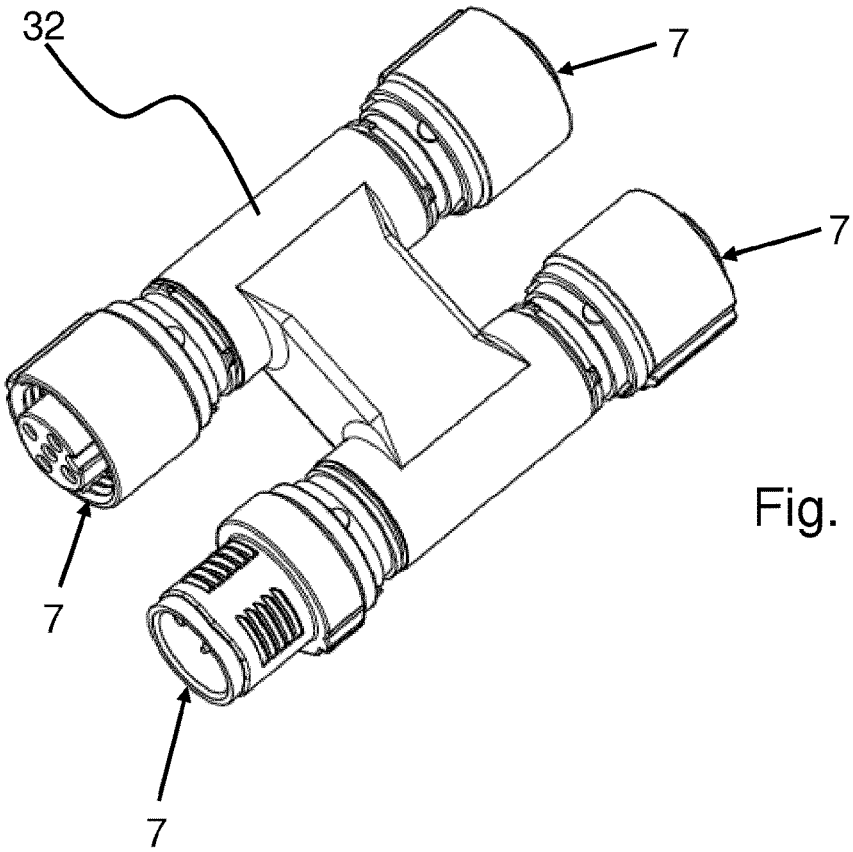
FIG. 25 shows the distributing body with cast around intermediate insulation.
Figure 26:
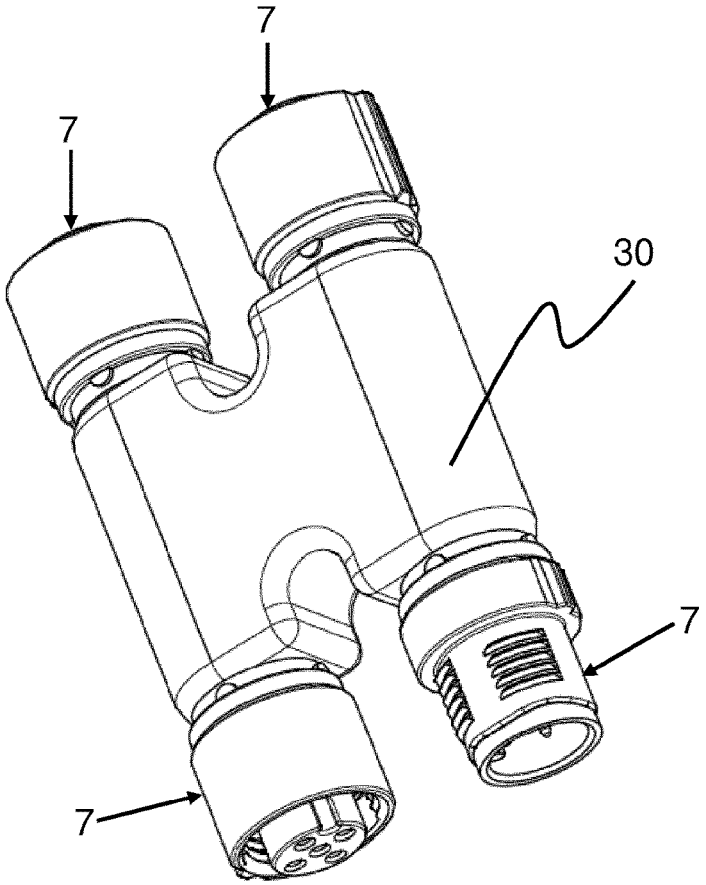
FIG. 26 shows the multiway terminal block with shielding housing.

The plug connectors 7 comprise a metallic connection member forming an outer shielding housing 70 (FIG. 28) and serving as a coupling part to a complementary mating plug connector. Inside the shielding housing 70 an electrically insulating connector housing 76 for holding the contact elements 74 is installed. The contact elements 74 are connected with the distributing body 8 at associated connection points 83 or 84, and have extensions forming conductor elements 71. Starting from the state of FIG. 24, an intermediate insulation 32 is injection-molded around the conductor elements 71 and the distributing body 8 so that the state according FIG. 25 is reached. Subsequently, a shielding housing 30 (FIG. 26) is cast around the intermediate insulation 32 that is produced as a metal body cast in situ, which is interlocked with the shielding housing 70 of the plug connector 7 (FIG. 28) and therefore has an extremely low contact resistance between the parts 70 and 30. The shielding housing 30 surrounds the intermediate insulation 32 without a gap, and thus offers a strong shielding of the whole connector, also in the area of the distributing body 8.

In order to make the connector look like other commercially available connectors, a protective shell 33 is then placed around the shielding housing 30. The completed plug connector is shown in FIG. 27.

Figure 27:
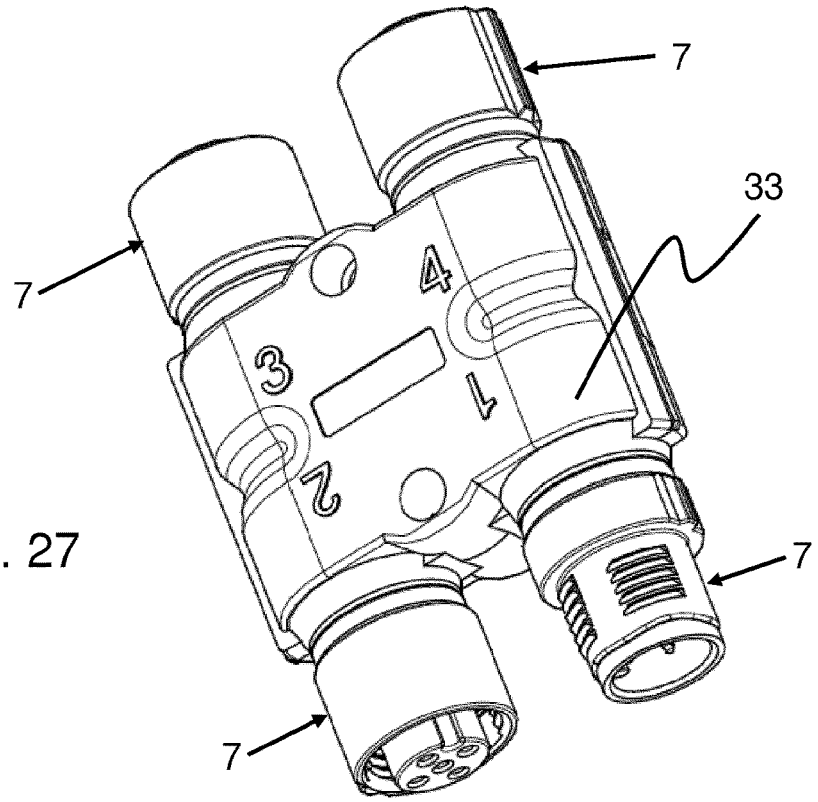
FIG. 27 shows the multiway terminal block of FIG. 26 with a protective shell.
Figure 28:
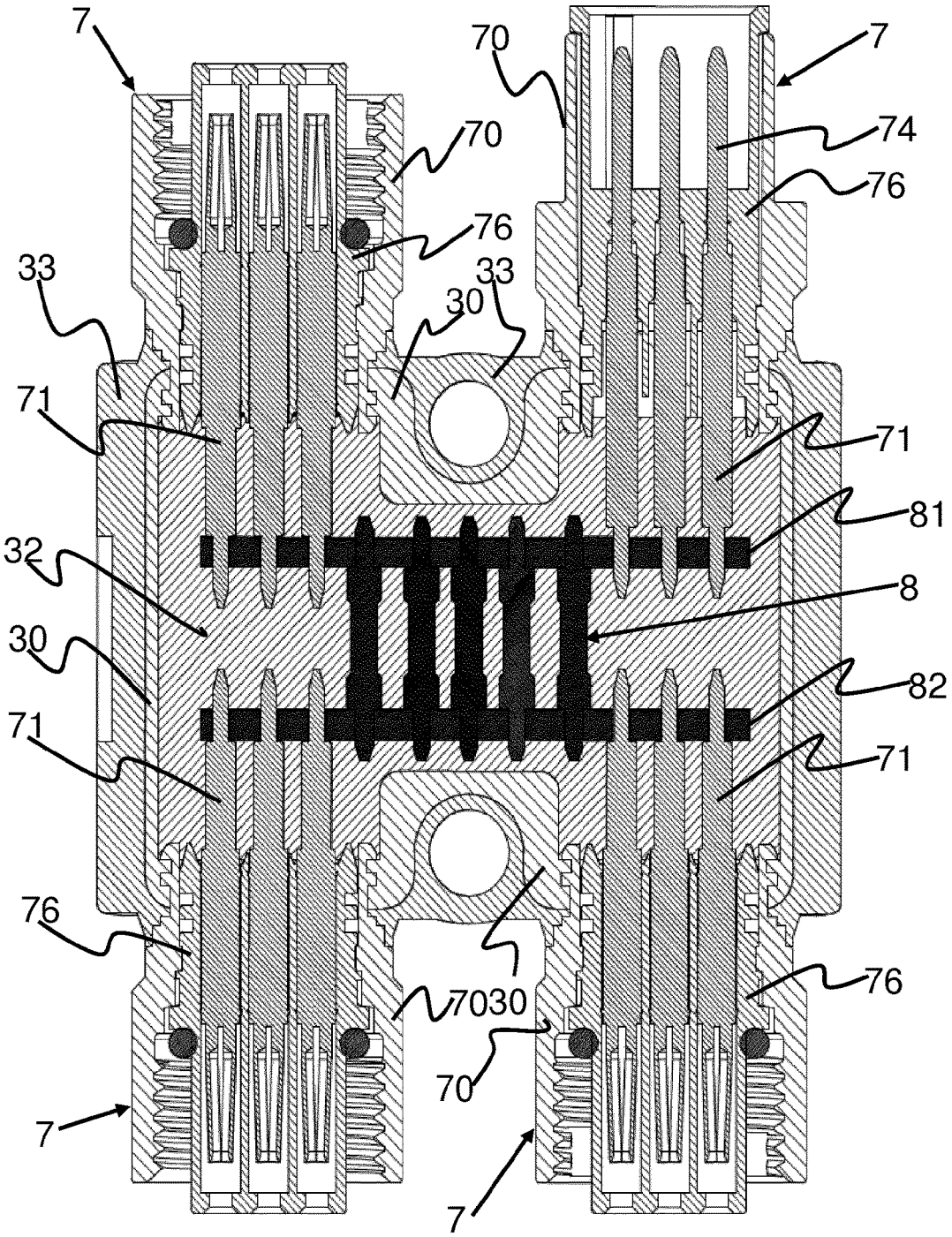
FIG. 28 is a longitudinal section through the multiway terminal block of FIG. 27.

The connector of FIG. 27 formed as a multiway terminal block may also be modified so as to comprise one or several shielded lines without all the plug connectors 7. In other words, one or several, or all plug connectors 7 may be replaced with directly connected shielded lines 1 or 2. In this case, the conductor elements 11, 21 of the respective lines are connected with the distributing body 8 in the manner of the conductor elements 71. Subsequently, the intermediate insulation 32 is produced by means of injection molding, and the intermediate insulation 32 is cast around with the shielding housing 30 made of metal, and by doing so, the electric connection with the shielding sleeve 10, 20 of each connected line 1, 2 is established. Then, if desired, the protective shell 33 is attached.

For the purpose of the present disclosure, various low-melting metal and metal alloys, in particular metal solders, may be used. All lead-containing tin solders, all lead-free tin solders, also Sn—Bi solders with a melting point around 130° C. as well as silver solders are also an option. Tinned members can be used as the shielding sleeve 10 of the relevant lines or the connection part 41 of a connector fashioned in this manner to assist the connection with the shielding housing 30, in particular, if the connection consists of a tin solder, hence fusing this with the shielding housing 30. In addition, nickel plating of the parts in question is possible. These parts, however, may also consist of blank stainless steel. Shielding sleeves may also be formed as a shield braid made from copper wires.

For the stability of the connection between the connection part 41 on the one hand and the shielding housing 30 on the other hand, or between the shielding sleeve 10 and the shielding housing 30, respectively, it is desirable if there are thin fins and thin shielding wires, which strongly heat up with the metal casting around so that if these parts are tinned, the surfaces of these thin parts will fuse locally, and solid soldering takes place there. An especially low electric contact resistance thus results.

During test executions, the plug connector according to the present disclosure has shown a contact resistance in the milliohm range. This very low contact resistance remained unchanged, also after great temperature changes.

A further remarkable characteristic of the connector according to the present disclosure is the formation of the shielding housing 30, resulting in a completely self-contained unit, apart from the axial openings for accommodating the supply lines or plug connectors. The shielding of each connected line or of the plug connector head is connected at these openings and completes the full shielding at a 360° space angle. In other words, the shielding housing 30 therefore is radially complete, preferably in the area of the line connections, and closed without gap. The shielding housing 30 therefore in particular forms a metal sleeve closed along the whole perimeter of the shield connection.

Further Possible Modifications

The intermediate insulation 32 serves for protecting and/or insulating the conductor elements (cores in the case of a cable or back ends of the contact elements in the case of a plug connector) and may be produced in a manner other than by casting around the conductor elements with insulating plastics. Sealings, shrink tubes, plastics housings and adhesives, or prefabricated components can be used for protecting the conductor elements against the liquid metal when producing the shielding housing 30.

With some embodiments of the intermediate insulation 32, the shielding sleeve 10 may protrude in excess of the cutting area 14 so as to have the possibility to electrically connect the shielding housing 30 at this protruding end of the shielding sleeve 10 by means of casting around with liquid metal.

Producing the intermediate insulation 32 may also be carried out using the low pressure method so as to make direct sealing on the conductor elements 11 or at the shielding sleeve 10 possible.

The protective shell 33 need not necessarily be produced by casting around with plastics. A prefabricated component, like a grommet, may also be used as a protective shell 33.

It is apparent to the person skilled in the art that the embodiments described herein have to be understood as examples, and that the invention is not limited to these embodiments, and may vary in a number of ways, yet remain within the scope of protection of the claims. Furthermore, it is apparent that the features, regardless of whether they are disclosed in the description, in the claims, in the figures, or otherwise, also individually define parts of the present disclosure, even if they are described together with other features.

The invention claimed is:

1. A shielded, electrical connector, comprising: one or several conductor elements belonging to at least one line, an intermediate insulation of temperature-resistant, electrically insulating material, disposed at least partially over the one or several conductor elements, one or several shielding sleeves belonging to the at least one line, a shielding housing connecting the one or several shielding sleeves, wherein the shielding housing includes an in-situ cast metal body, which has been cast in situ from liquid metal or liquid metal alloy and disposed directly on and around and in contact with the intermediate insulation, which protects the conductor elements during the casting process of the shielding housing, and onto annular regions of the one or several shielding sleeves, wherein the in-situ cast shielding housing is formed for establishing an anchoring means having a low electric contact resistance and effecting a closed and complete shielding of the connector, and an electrically insulating protective shell around the shielding housing.

2. The connector as claimed in claim 1, wherein one of the conductor elements is on protective earth, and the shielding housing is electrically connected with the protective earth using a cast branching.

3. The connector as claimed in claim 1, formed as a multiway terminal block for one or several shielded lines, comprising: a distributing body with several connection points for the conductor elements that belong either to one or several lines, said intermediate insulation that surrounds the distributing body and conductor elements adjacent thereto.

4. A method for producing the connector set forth in claim 3, namely formed as a multiway terminal block, the connector connecting one or several shielded lines and/or one or several shielded plug connectors with one another, the method comprising the steps of:

a) baring a shielding sleeve and conductor elements at the end of the shielded line or lines to be connected, and/or providing the shielded plug connector or connectors, each having a respective shielding plug housing and respective plug conductor elements, b) connecting the conductor elements or plug conductor elements with a distributing body, c) applying an inner intermediate insulation on the conductor elements bared, or on the plug conductor elements bared, and around the distributing body, d) casting liquid metal or liquid metal alloy around the inner intermediate insulation and the shielded sleeve bared when a shielded line is to be connected and/or onto an edge area of the shielded plug housing when a shielded plug connector is to be connected, for forming a shielding housing.

5. The connector as claimed in claim 1, wherein the electrically insulating protective shell is an injection molded plastic shell.

6. The connector as claimed in claim 1, wherein the shielding housing includes a low melting metal alloy.

7. The connector as claimed in claim 6, wherein the metal alloy is a tin solder.

8. A method for producing the connector set forth in claim 1, the connector connecting a first shielded line with a second shielded line, the method comprising the steps of:

a) baring shielding sleeves and the conductor elements at the ends of the first and of the second lines, b) connecting the bared ends of the conductor elements with one another, c) applying the intermediate insulation on the bared ends of the conductor elements, which are connected with one another, d) casting liquid metal or liquid metal alloy around the intermediate insulation and the bared shielding sleeves for forming the shielding housing.

9. The method as claimed in claim 8, wherein step d) includes injection molding the electrically insulating protective shell around the shielding housing.

10. A method for producing the connector set forth in claim 1, the connector connecting conductor elements of a shielded line with contact elements of the connector, the method comprising the steps of: a) baring a shielding sleeve and the conductor elements at the end of a shielded line, b) applying contact elements at the end of the conductor elements and insulating the contact elements from one another by means of an insulating connector housing, c) applying the intermediate insulation on conductor elements that have bared ends, and d) casting liquid metal or liquid metal alloy around the intermediate insulation and the bared shielding sleeve for forming a shielding housing.

11. The method as claimed in claim 1, wherein the intermediate insulation is an injection molded plastic intermediate insulation.

12. A method for producing a connector, comprising the steps of:

a) connecting bared ends of conductor elements with one another, b) applying an intermediate insulation on the bared ends of the conductor elements connected with one another, c) casting in situ liquid metal or liquid metal alloy to form a cast metal body, around and in contact with the intermediate insulation, and around and in contact with one or several shielding sleeves once bared and/or one or several shielding housings for forming an in-situ cast shielding housing, wherein the in-situ cast shielding housing is formed for establishing an anchoring means having a low electric contact resistance and effecting a closed and complete shielding of the connector; and d) surrounding the shielding housing with an electrically insulating protective shell.

13. The method as claimed in claim 12, insofar as shielded lines are concerned, wherein each a soldered connection between a shielding housing and a shielding sleeve or sleeves of the shielded lines is provided by partially fusing metal at the shielding sleeve in question.

* * * * *